US010575554B2

(12) United States Patent
Esposti et al.

(10) Patent No.: US 10,575,554 B2
(45) Date of Patent: Mar. 3, 2020

(54) MACHINE AND METHOD FOR PRODUCING SUBSTANTIALLY CYLINDRICAL ARTICLES OF THE TOBACCO PROCESSING INDUSTRY

(71) Applicant: G.D SOCIETA' PER AZIONI, Bologna (IT)

(72) Inventors: Marco Esposti, Casalecchio di Reno (IT); Nicola Baldanza, Zola Predosa (IT); Massimo Sartoni, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 207 days.

(21) Appl. No.: 15/532,120

(22) PCT Filed: Dec. 2, 2015

(86) PCT No.: PCT/IB2015/059299
§ 371 (c)(1),
(2) Date: Jun. 1, 2017

(87) PCT Pub. No.: WO2016/088064
PCT Pub. Date: Jun. 9, 2016

(65) Prior Publication Data

US 2017/0265518 A1 Sep. 21, 2017

(30) Foreign Application Priority Data

Dec. 2, 2014 (IT) ..... BO2014A0680

(51) Int. Cl.
*A24D 3/02* (2006.01)
*A24D 3/16* (2006.01)

(52) U.S. Cl.
CPC ..... *A24D 3/0287* (2013.01); *A24D 3/0225* (2013.01); *A24D 3/163* (2013.01)

(58) Field of Classification Search
None
See application file for complete search history.

(56) References Cited

U.S. PATENT DOCUMENTS 3,517,480 A * 6/1970 Pinkham ..... A24D 3/0225 141/147
4,676,360 A 6/1987 Mattel et al.
(Continued)

FOREIGN PATENT DOCUMENTS

EP 1226765 A2 7/2002
EP 1228709 A1 8/2002
(Continued)

OTHER PUBLICATIONS

International Search Report and Written Opinion, International application No. PCT/IB2015/059299, dated Apr. 26, 2016.
(Continued)

*Primary Examiner* — Hemant Desai
*Assistant Examiner* — Tanzim Imam
(74) *Attorney, Agent, or Firm* — Marshall, Gerstein & Borun LLP

(57) ABSTRACT

A method of producing filter tips for cigarettes, each of which comprises two portions of filter material arranged on opposite ends of a portion of granular material; the first portion of filter material is wrapped in a sheet so as to obtain an intermediate element having a substantially tubular shape and an open end; the granular material and the second portion of filter material are then inserted through the open end, while the intermediate element is kept vertical with the open end facing upwards; in this way it is possible to obtain high quality filter tips at high speed.

19 Claims, 9 Drawing Sheets

(56) References Cited

U.S. PATENT DOCUMENTS

| | | | | |
|---|---|---|---|---|
| 2002/0119874 | A1* | 8/2002 | Heitmann | A24C 5/475 493/39 |
| 2009/0075798 | A1* | 3/2009 | Garthaffner | A24D 3/0287 493/48 |

FOREIGN PATENT DOCUMENTS

| | | | |
|---|---|---|---|
| EP | 2777408 | A1 | 9/2014 |
| WO | WO-2006/048767 | A1 | 5/2006 |
| WO | WO-2007/138483 | A2 | 12/2007 |
| WO | WO-2014/064655 | A2 | 5/2014 |

OTHER PUBLICATIONS

MULFI-E Dual-Filter Production Line, Hauni brochure (Jun. 30, 2000).

* cited by examiner

MACHINE AND METHOD FOR PRODUCING SUBSTANTIALLY CYLINDRICAL ARTICLES OF THE TOBACCO PROCESSING INDUSTRY

CROSS-REFERENCE TO RELATED APPLICATIONS

This application is the U.S. National Stage application of International Patent Application No. PCT/IB2015/059299, filed Dec. 2, 2015, which claims the benefit of Italian Patent Application No. BO2014000680, filed Dec. 2, 2014.

TECHNICAL FIELD

The present invention relates to a machine and a method for producing substantially cylindrical articles of the tobacco processing industry.

BACKGROUND ART

In the tobacco processing industry, it is known to produce multi-segment filter tips provided with different materials.

The patent application bearing publication number US2014/2061470 describes the production of a cylindrical article comprising a filter segment, a segment of granular material and a segment of tobacco. To obtain this cylindrical article, a band of flexible material is wrapped around the filter segment so as to obtain a cup-like form, which is filled with the granular material. At this point, the segment of tobacco is placed on top and is only subsequently connected to the remaining parts of the article by rolling a sheet of paper material around the segment of tobacco and the segment of filtering material. The above-described operations are performed while keeping everything vertical.

That proposed by patent application US2014/2061470 has several drawbacks, from which we cite the fact that production is relatively slow and of low quality.

DISCLOSURE OF INVENTION

It is an object of the present invention to provide a machine and a method that enable at least partially overcoming the drawbacks of the known art and, at the same time, are of easy and inexpensive implementation.

According to the present invention, a method is provided for producing substantially cylindrical articles of the tobacco processing industry according to that set forth in the independent claim below and, preferably, in any of the dependent claims directly or indirectly dependent on the above-mentioned independent claim.

According to a further aspect of the present invention, a machine is provided for producing substantially cylindrical articles of the tobacco processing industry, as described below. In particular, the machine is designed to implement the above-mentioned method.

BRIEF DESCRIPTION OF THE DRAWINGS

The present invention will now be described with reference to the accompanying drawings, which illustrate a non-limitative embodiment, in which.

BEST MODE FOR CARRYING OUT THE INVENTION

Figure 1:
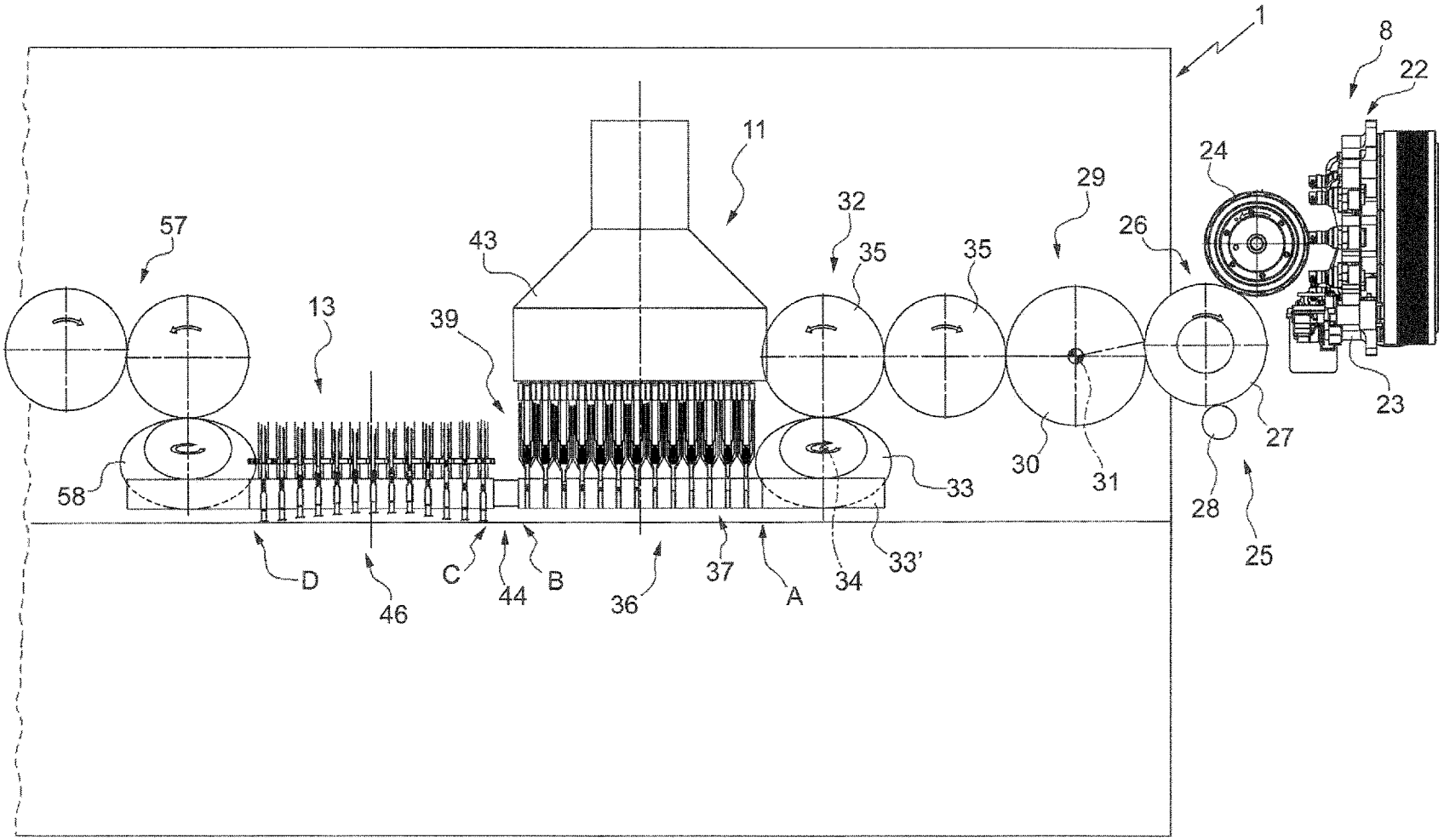
FIG. 1 is a schematic side view, with some details removed for clarity, of a machine for implementing a method in accordance with the present invention.
Figure 15:
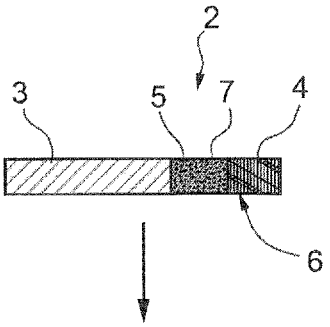

In accordance with a first aspect of the present invention, in FIG. 1, reference numeral 1 indicates, as a whole, a machine for producing substantially cylindrical articles 2 of the tobacco processing industry (FIG. 15). Each substantially cylindrical article 2 comprises a respective portion 3 having (in particular, consisting of) a first material (for example, tobacco and/or a filtering material such as cellulose acetate) of the tobacco processing industry, at least one respective portion 4 having (in particular, consisting of) a second material (for example, tobacco and/or a filtering material such as cellulose acetate) of the tobacco processing industry, at least one respective portion 5 having (in particular, consisting of) a loose third material different from the first and second materials, and a respective cover 6 having at least one associated sheet 7 wrapped (in particular, in a substantially tubular manner) around portions 3, 4 and 5.

In particular, the sheet 7 comprises (more precisely, consists of) paper. However, more generally, the sheet 7 could be made of a pliable material and therefore in addition to paper, could be made of a metal foil or plastic. Thus, the material with which sheet 7 is made is not limited to the described embodiments. Instead, as used here, the term pliable material generally refers to a ribbon-like material that has a certain resistance to bending or that has a certain level of plastic deformation, for example, a metal foil or a paper-laminated metal foil.

In addition to the above examples, other embodiments could include, without limitation, thin sheets of plastic, polymers, composites, rubber or other materials known in the art.

According to some embodiments, the cover 6 has other elements in addition to sheet 7, such as one or more other sheets and/or bands (for example, of paper and/or tin foil), these also wrapped in a tubular manner around portions 3, 4 and 5.

According to mutually alternative embodiments, the first and the second materials are the same or are different.

Advantageously, it may be noted that the cover is usefully in contact with portions 3 and 4.

The substantially cylindrical article 2 usually has a substantially circular cross-section.

According to some embodiments, the loose material is a powdered or granulated (in particular, granulated) material. For example, the loose material could comprise (more precisely, consist of) activated carbon (particles).

According to specific embodiments, the article 2 is a filter tip and portions 3 and 4 are made of a filtering material.

The machine 1 comprises a processing assembly 8 to wrap the sheet 7 around portion 3 (FIGS. 1, 4 and 5) so as to obtain an intermediate element 9 (FIGS. 11 and 12) having a substantially tubular shape with an open end 10; an insertion device 11 (FIGS. 1, 2 and 5) to insert the third material through the open end 10, into the intermediate element 9 (in contact with portion 3) so as to obtain an intermediate element 12 (FIG. 13); and an insertion device to insert the second material into the intermediate element 12 through the open end 10 so that the third material is located (enclosed) between portions 3 and 4.

The insertion devices 11 and 13 are designed to hold the open end 10 facing upwards.

According to some embodiments, the processing assembly 8 comprises a forming device 14 (FIG. 4), which is designed to wrap a strip 15 (in use, continuously fed in a substantially horizontal direction; in particular, see FIGS. 4, 6, 7 and 8) around a succession of segments 16, each comprising (in particular, consisting of) the first material and being substantially twice as long as portion 3 so as to obtain a rod 17.

A transfer device 18 (in itself known, in particular a so-called spider—FIG. 8) is designed to carry the segments on the strip 15 (FIG. 7) so that gaps 18 are left between the segments 16.

Figure 4:
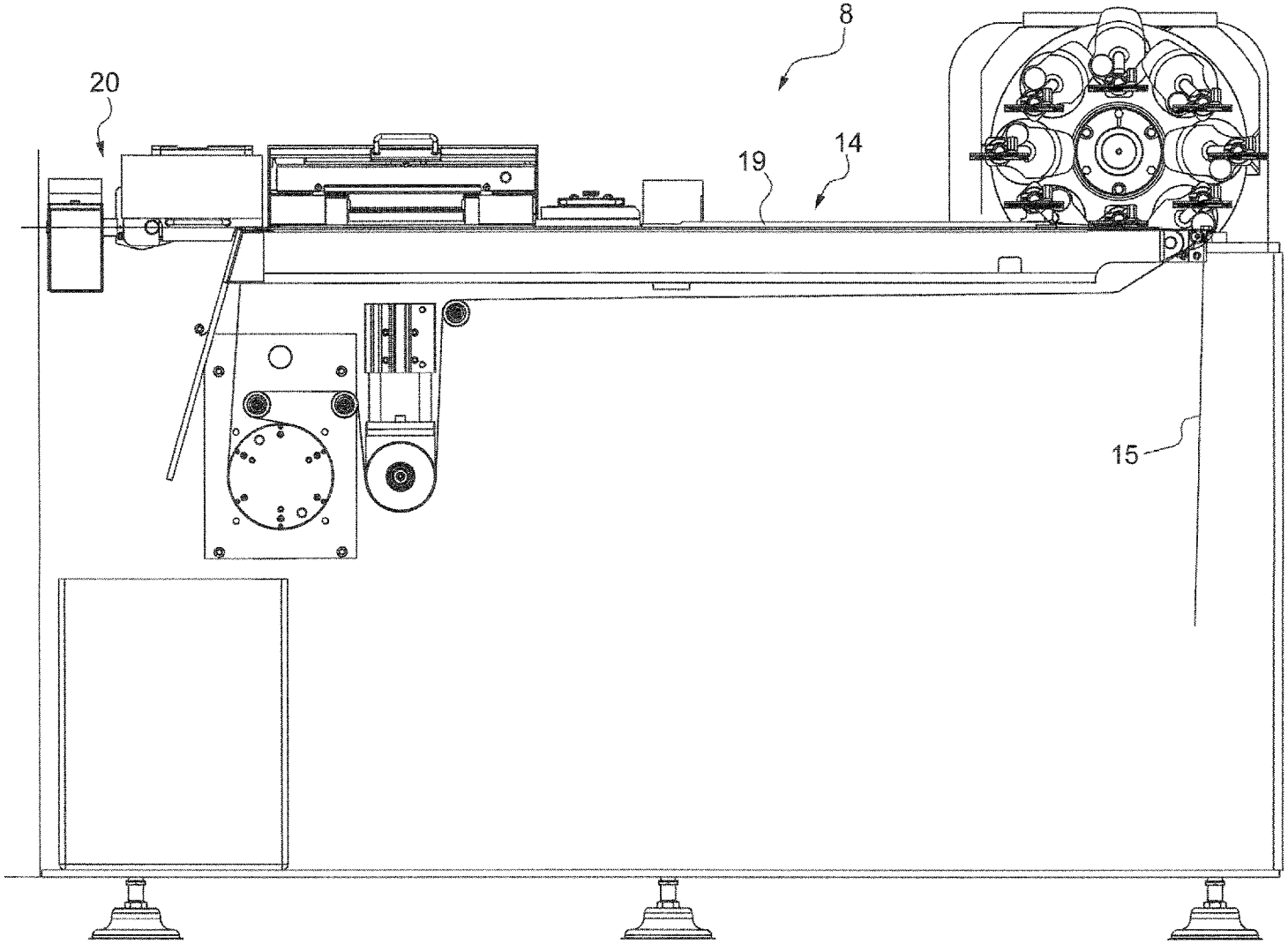
FIG. 4 is a side view, on an enlarged scale, of a further part of the machine in FIG. 1.
Figure 5:
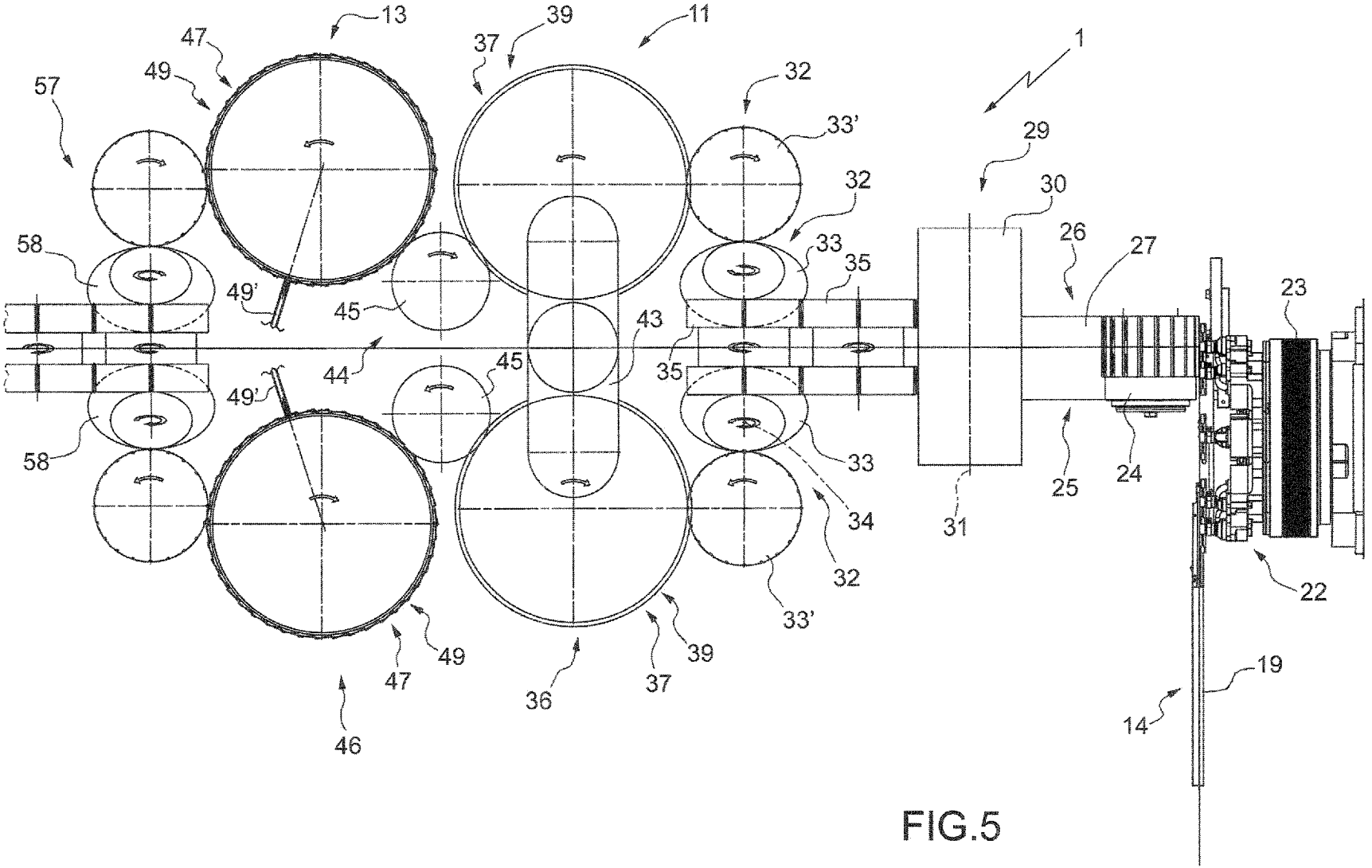
FIG. 5 is a schematic top view, with some details removed for clarity, of the machine in FIG. 1.

In some cases, the forming device 14 is of a known type and comprises a forming beam 19 (also of a known type; see FIGS. 4 and 5).

Figure 10:
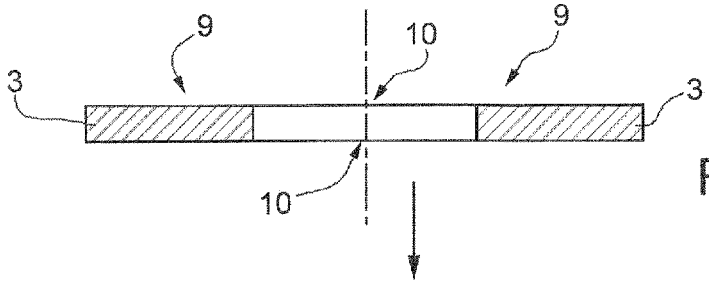

In particular, the processing assembly 8 also comprises a cutting device 20 (FIG. 4) to cut (FIG. 8) the rod 17 crosswise at segments 16 (while the rod 17 is fed longitudinally and, in particular, horizontally) so as to obtain pairs 21 of intermediate elements 9 (linked together; FIG. 10).

According to specific embodiments, the processing assembly 8 comprises (FIG. 1) a transfer device 22 (in turn, comprising a spider 23 and a conveyor wheel 24) to carry the pairs 21 individually and in succession to a cutting station 25, where a cutting device 26 is located to cut (FIG. 10) each pair 21 at the associated gap 18 so as to obtain two portions 3.

Advantageously, the cutting device 26 (FIGS. 1 and 5) comprises a conveyor wheel 27 and a (rotatable) blade 28 arranged along the circumference of the conveyor wheel 27.

Figure 11:
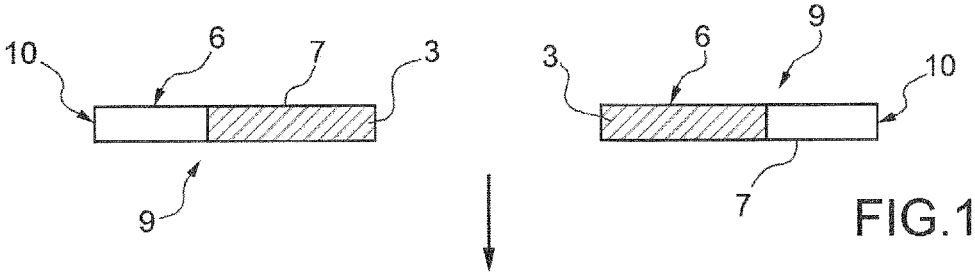

According to some embodiments, the machine 1 also comprises a rotation device 29, which is located downstream of the cutting device 26, to rotate the intermediate elements 9 of a cut pair 21 (by approximately 180°) so that the intermediate elements 9 move apart and have the open ends 10 oriented in mutually opposite directions (FIG. 11).

In particular, the rotation device 29 comprises a wheel 30 designed to rotate about its axis 31 and is, for example, structured as described in American patent U.S. Pat. No. 4,676,360.

Figure 12:
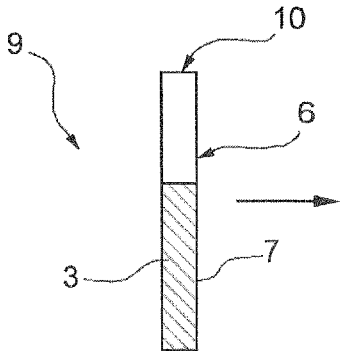

According to some embodiments, the machine 1 also comprises a rotation assembly 32 (FIGS. 1 and 5) to rotate the intermediate element 9 in a way that it has the open end 10 facing upwards (FIG. 12; in particular, so as to give the intermediate element 9 a substantially vertical orientation).

In this text (unless expressly indicated otherwise), "vertical" or "substantially vertical" orientation means an orientation according to which the components having a length greater than the width (or, in any case, the diameter) are oriented such that the length has a vertical or substantially vertical orientation.

The rotation assembly 32 comprises a truncated cone shaped drum 33 (of a type in itself known; in this specific case, there are two drums 33, each one for rotating respective intermediate elements 9) having a rotation axis 34 inclined by 45° with respect to the vertical and with seats (of a type in itself known and not shown, oriented at 45° with respect to the rotation axis 34).

According to the embodiment shown (FIGS. 1 and 5), two transfer wheels 35 are placed between the rotation device 29 and the rotation assembly 32 to carry the intermediate elements 9 from the rotation device 29 to the rotation assembly 32.

Figure 2:
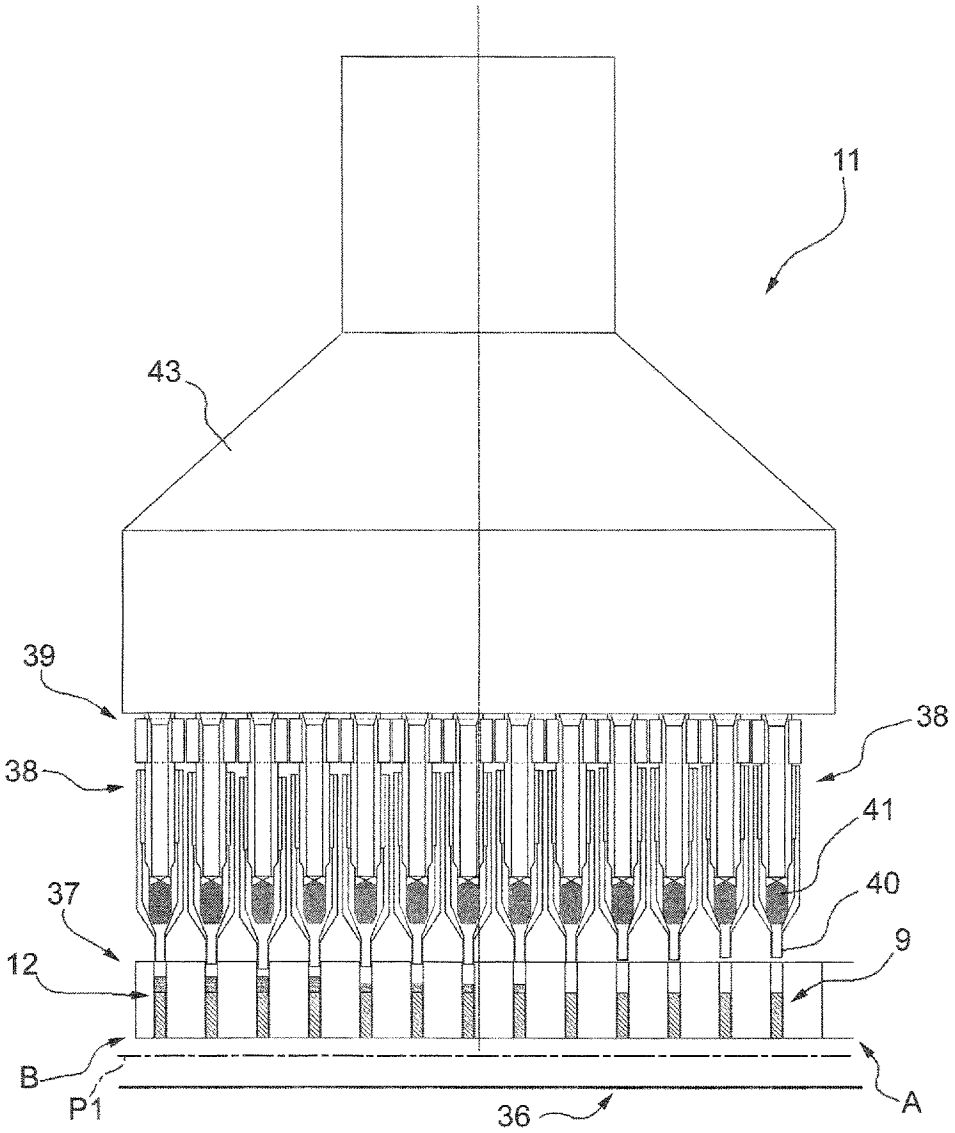
FIG. 2 is a side view, on an enlarged scale, of a part of the machine in FIG. 1.

In particular, with reference to FIG. 2, the insertion device 11 is located at an insertion station 36 and comprises a conveyor 37 (more precisely a conveyor wheel; in this specific case, two conveyor wheels, each one for conveying respective intermediate elements 9) provided with a plurality of seats, each of which is designed to be engaged by an associated intermediate element 9, to carry each intermediate element 9 along an insertion path P1 through the insertion station 36, from an entry station A to an exit station B. Moreover, the insertion device 11 typically comprises a plurality of insertion units 38, each of which is designed to enable the transfer of loose material into a respective intermediate element 9 through the open end 10. In particular, the insertion device 11 comprises a conveyor 39 (more precisely a conveyor wheel; in this specific case, two conveyor wheels) to feed each insertion unit 38 along the path P1 in phase with the respective intermediate element 9 so as to have an associated insertion nozzle 40 (of each unit 38) facing a respective open end 10.

Advantageously, the conveyors 37 and 39 are substantially integral with each other (in this way, easily ensuring the movement of the units 38 in phase with the intermediate elements 9) and thus define a single conveyor.

Advantageously, the insertion device 11 comprises a handling system (of a type in itself known and not shown; for example comprising a cam system and/or a system of linear motors) to move (more precisely, to lower and subsequently raise) the nozzles 40 inside the intermediate element 9 through the open end 10. Thanks to the above-mentioned handling system, each nozzle 40 is opened when the nozzle is placed (at least partially) inside the open end.

Figure 16:
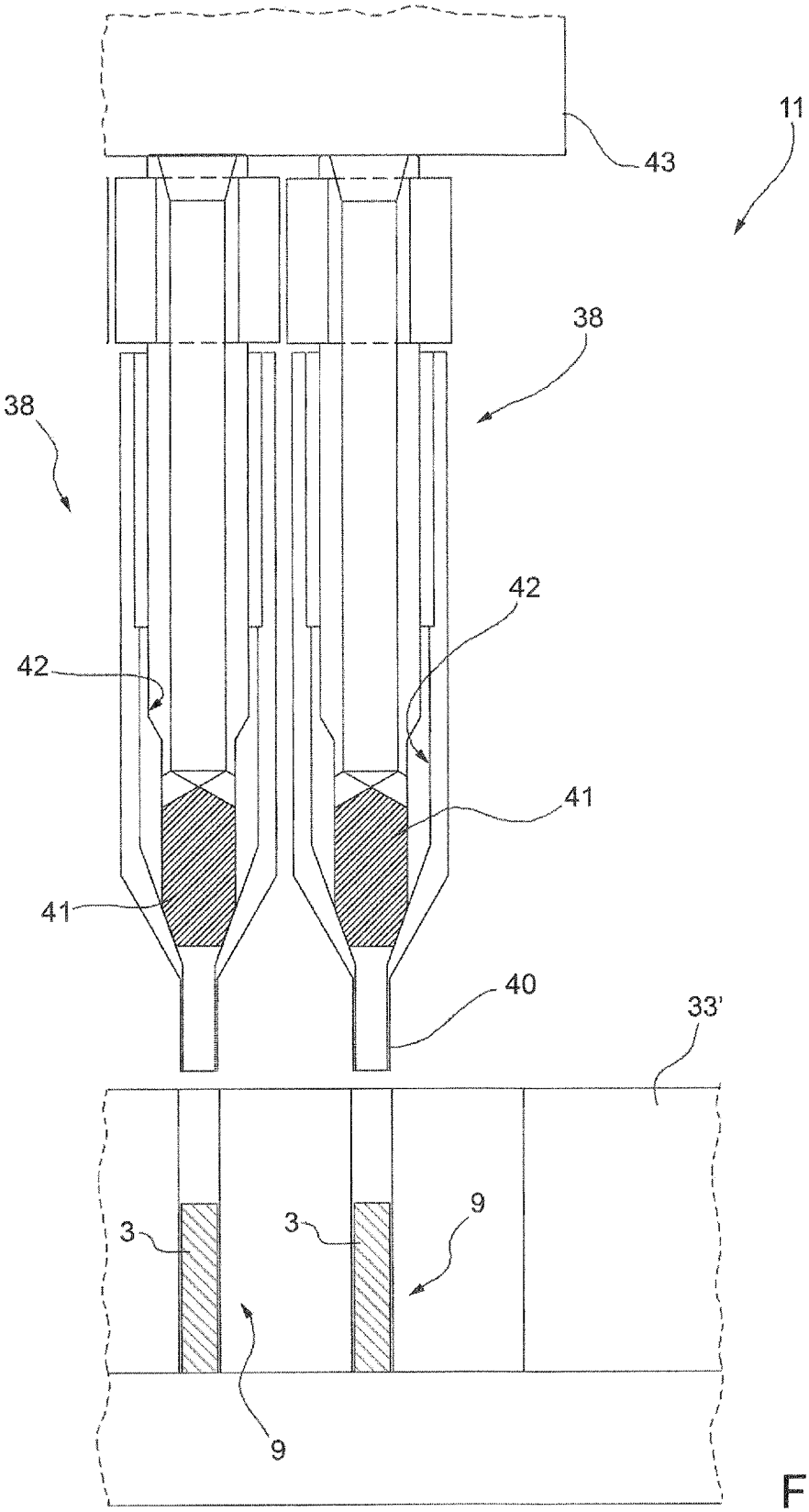
FIG. 16 shows, on an enlarged scale, a detail of FIG. 2.

In particular, the opening of each nozzle 40 is achieved by a relative separating movement between the nozzle 40 and a respective blocking element 41 (of each insertion unit 38), located inside a feed channel 42 (of each insertion unit 38) of the loose material (FIG. 16). More precisely, the handling system is designed to bring each nozzle 40 toward the intermediate element 2 (in particular, downwards) so as to move the nozzle 40 away from the respective blocking element and therefore open the nozzle 40 and allow the passage of the loose material through the nozzle 40. In practice, the insertion device 11 is designed to keep the blocking element 41 vertically fixed.

As a consequence of insertion of the loose material in each intermediate element 9, the respective intermediate element 12 is obtained.

The above-mentioned handling system is designed to move each nozzle 40 away from the respective intermediate element 12 at the exit station B. The upward movement of the nozzle 40 causes the blocking element 41 to engage again and therefore close the nozzle 40.

Usually, a hopper 43, designed to house the loose material and feed each feed channel 42, is located above the insertion units 38.

According to specific embodiments (such as that shown), a conveyor drum (two in this specific case) 33' is provided to carry the intermediate elements 9 from the drum 33 to the insertion device 11.

According to an embodiment that is not shown, the machine 1 advantageously comprises a suction device connected to the intermediate elements 9, on the opposite side to the open end 10, i.e. at the end where the nozzle 40 is, so that, in use, the loose material is held inside the intermediate element 9 by suction during the filling and/or during the subsequent transport steps.

Advantageously, the machine 1 also has an application unit 44 (FIGS. 1 and 5) to apply an adhesive substance inside the open end 10. In particular, the application unit 44 is designed to apply the adhesive substance on the inner surface of the open end 10. In this way, more solid positioning of portion 4 inside the substantially cylindrical article 2 is achieved.

In accordance with that shown, the application unit 44 comprises a conveyor roller 45 to carry the intermediate element 12 to the insertion device 11 (more precisely, from the exit station B to an entry station C). According to some embodiments, the application unit 44 comprises a plurality of spray nozzles (not shown) designed to spray the adhesive substance once they are each arranged facing (more precisely, inside) the respective open end 10. Alternatively, the application unit 44 comprises a plurality of spreaders (not shown).

Figure 3:
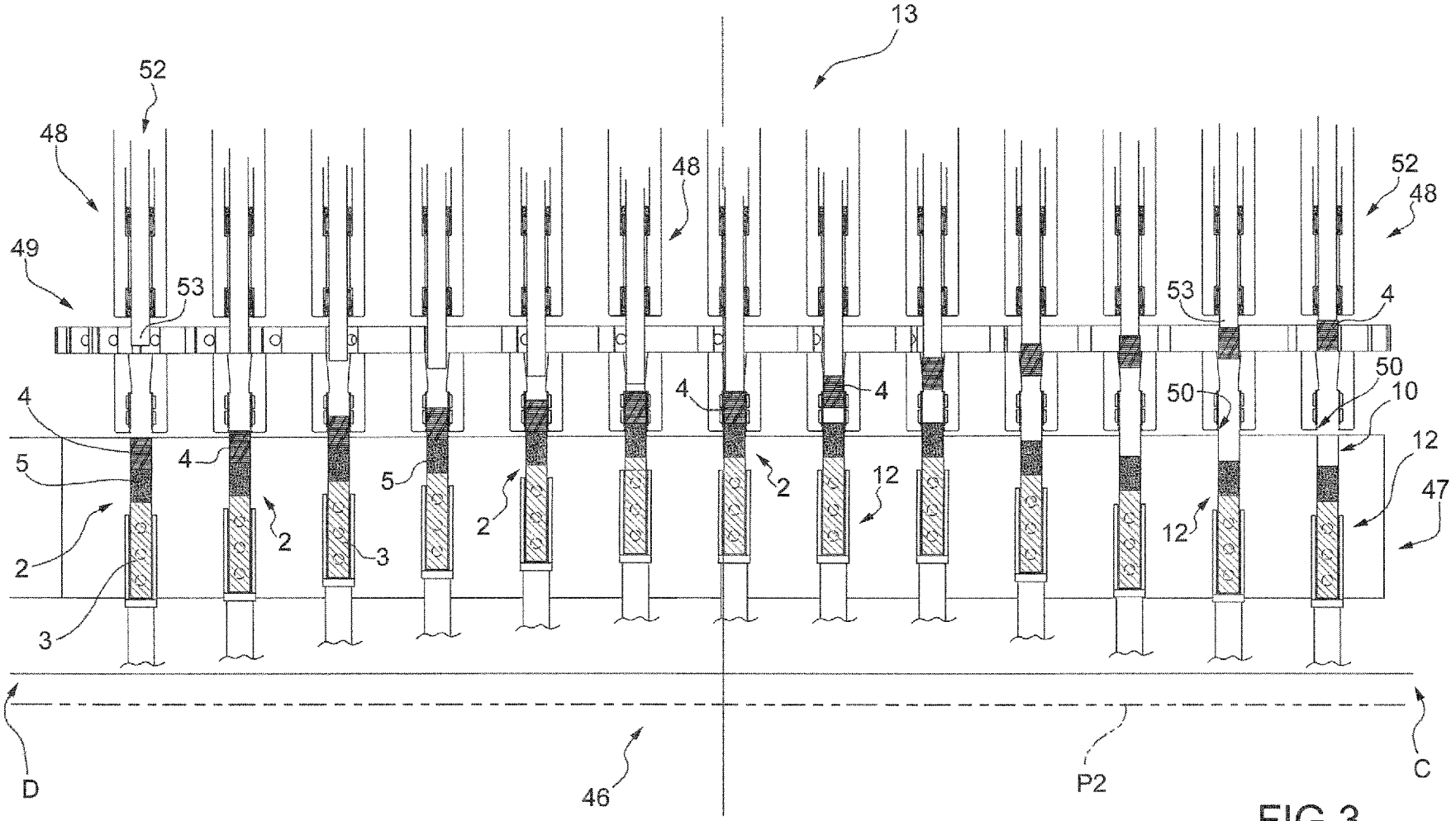
FIG. 3 is a side view, on an enlarged scale, of a further part of the machine in FIG. 1.
Figure 17:
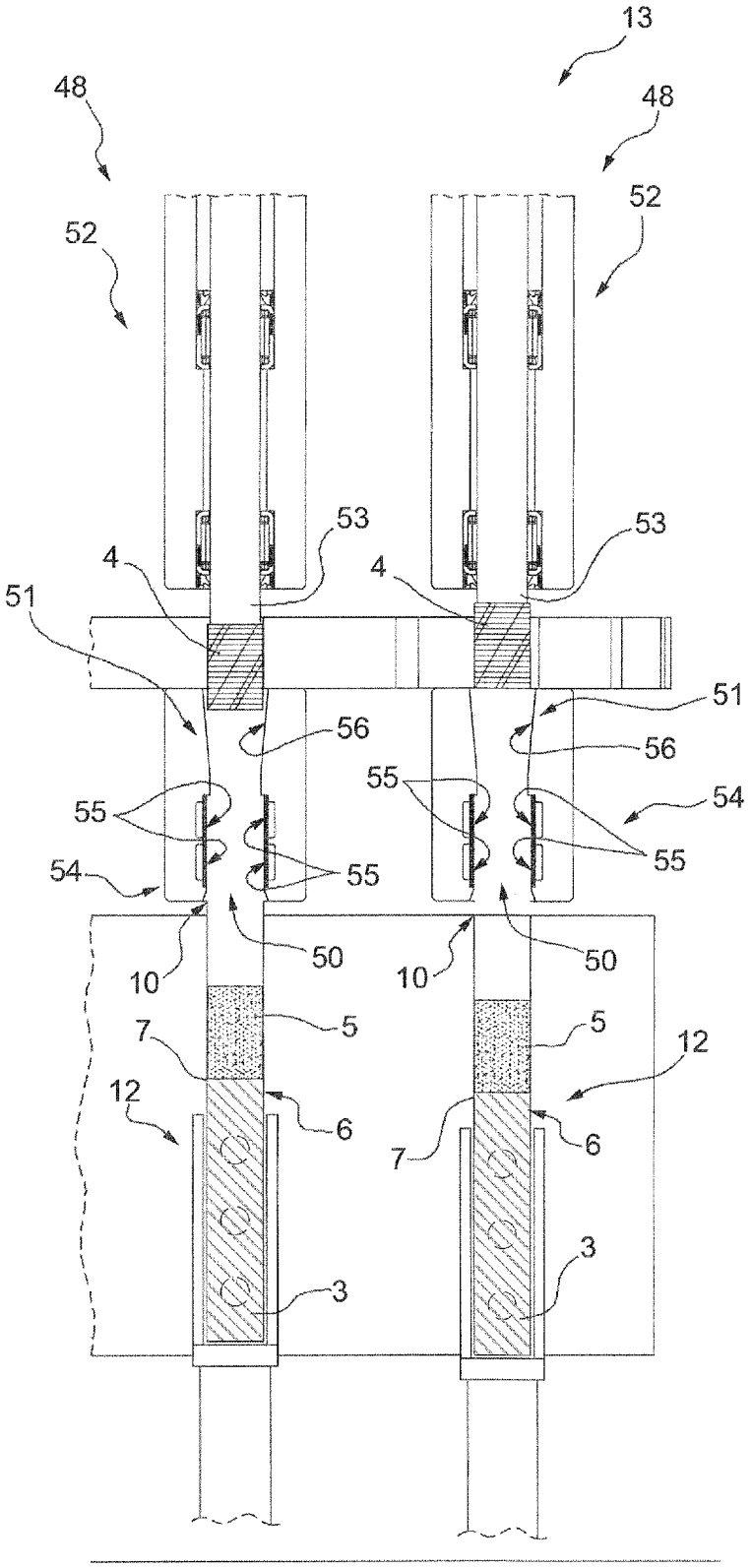
FIG. 17 shows, on an enlarged scale, a detail of FIG. 3.

In particular, referring to FIGS. 1, 3 and 17, the insertion device 13 is located at an insertion station 46 and comprises a conveyor 47 (more precisely a conveyor wheel; in this specific case, two conveyor wheels, each one for conveying respective intermediate elements 12) provided with a plurality of seats, each of which can be engaged by an associated intermediate element 12, to carry each intermediate element 12 along an insertion path P2 through the insertion station 46, from the entry station C to an exit station D. Usually, the insertion device 11 also comprises a plurality of insertion units 48, each of which is designed to enable the transfer of the second material into a respective intermediate element 12 through the open end 10. In particular, the insertion device 13 comprises a conveyor 49 (more precisely a conveyor wheel; in this specific case, two conveyor wheels) to feed each insertion unit 48 along path P2 in phase with the respective intermediate element 12 so as to have an associated insertion outlet 50 (of each insertion unit 48) facing a respective open end 10.

Advantageously, the conveyors 47 and 49 are substantially integral with each other (in this way, easily ensuring the movement of the insertion units 48 in phase with the intermediate elements 12) and thus define a single conveyor.

Advantageously, the insertion device 13 comprises a handling system (of a type in itself known and not shown; for example comprising a cam system and/or a system of linear motors) to produce a relative (in particular, longitudinal and, more precisely, vertical) movement between an insertion outlet 50 (of each insertion unit 48) and the intermediate element 12 so as to bring the open end 10 inside an insertion outlet 50.

More precisely, the above-mentioned handling system is designed to move the seats in which the intermediate elements 12 are housed vertically (longitudinally).

According to some embodiments, each insertion unit 48 comprises an insertion channel 51, the last section of which defines the insertion outlet 50 and through which portion 4 is fed.

Advantageously, the insertion device 13 also comprises a pusher unit 52 to push portion 4 inside the open end 10. In particular, the pusher unit is designed to push portion 4 against portion 5 so as to compress the loose material in portion 5. In this way, the position of the particles in portion 5 is stabilized and, in use, limits preferential gas paths around the particles.

According to some embodiments, for each insertion unit 48, the pusher unit 52 comprises a pusher head 53 moveable along the insertion channel 51. More precisely, the above-mentioned handling system is designed to move each pusher head 53 downwards when the open end 10 is inside the insertion outlet 50.

As a consequence of insertion of the loose material in each intermediate element 12, the respective substantially cylindrical article 2 is obtained.

The above-mentioned handling system is designed to move each insertion outlet 50 away from the respective substantially cylindrical article 2 at the exit station D.

Advantageously, each insertion unit 48 comprises an opening assembly 54 to exert a force (in particular, radial and centrifugal) on the open end 10 so as to keep it open. According to some embodiments, the opening assembly 54 comprises a plurality of suction openings 55 arranged (in a ring) at each insertion outlet 50. In this way, the risks of damaging the sheet 7 are reduced.

Advantageously, each insertion unit 48 comprises a deformation device to reduce the size (in particular, laterally) of portion 4 during insertion of said portion 4 into the open end 10. According to some embodiments, the above-mentioned deformation device comprises a section 56 of the insertion channel 51 having a width (in particular, a cross-section) less than the width (in particular, the cross-section) of portion 4. In particular, the section 56 is tapered towards the insertion outlet 50. Advantageously, the section 56 is arranged immediately (i.e. without the interposition of further sections) upstream of (in particular, above) the insertion outlet 50.

According to the embodiment shown, the portions 4 are fed to the insertion device 13 through a conduit 49' connected to a hopper (of a type in itself known and not shown).

Usually, a conveyor system 57 is arranged downstream of the insertion device 11 for the transfer of the substantially cylindrical article 2 obtained to further processing units (of known type and not shown). According to the embodiment shown, the conveyor system 57 is designed to carry the substantially cylindrical article substantially horizontally. More precisely (for this purpose), the conveyor system 57 comprises a truncated cone shaped drum 58.

Figure 9:
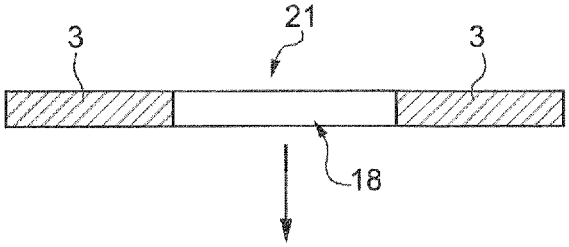

According to alternative embodiments, the processing assembly 8 comprises (instead of the forming 14, transfer 22 and rotation 29 devices, the spider 23 and the conveyor wheel 24) a simple rolling device (in particular, a rolling wheel—of a type in itself known, for example, from publication WO2014/064655 and not shown here) for rolling the sheet 7 around (the already single) portion 3 so as to (directly) obtain intermediate element 9. Alternatively, the sheet 7, of twice the length, can be wrapped around a pair of portions 3 so as to form the pair 21 in FIG. 9. This enables obtaining excellent bonding and rolling quality of the sheet 7 around portion 3.

In accordance with a second aspect of the present invention, a method is provided for producing substantially cylindrical articles 2 of the tobacco processing industry. Each cylindrical article 2 is defined as indicated above in accordance with the first aspect of the present invention.

According to specific and non-limitative embodiments, the method is implemented by the machine 1 in accordance with the first aspect of the present invention.

Figure 6:
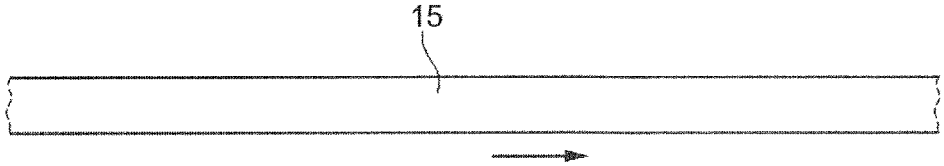
FIGS. 6 to 15 schematically illustrate a method in accordance with the present invention.
Figure 7:
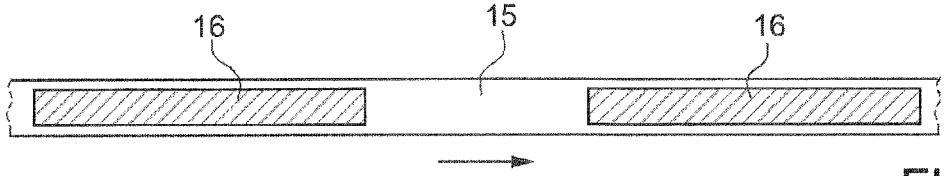
Figure 8:
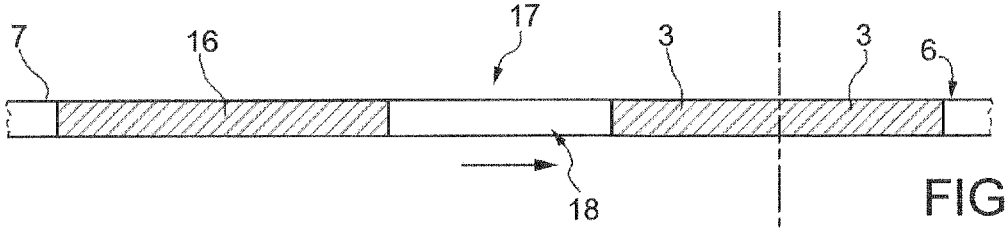

The method comprises a wrapping step, during which the sheet 7 is wrapped around a portion 3 so as to obtain intermediate element 9 having (a substantially tubular shape with) an open end 10 (FIGS. 6 to 8). In particular, intermediate element 9 has a substantially cylindrical shape and a substantially circular cross-section (FIG. 12).

Advantageously, portion 3 is placed at the opposite end to the open end 10. In other words, the opposite end to the open end 10 is closed by portion 3.

The method also comprises a first insertion step (FIG. 13), during which the loose third material is inserted through the open end 10 and into intermediate element 9 so as to obtain intermediate element 12; and a second insertion step (FIG. 14), during which the second material is inserted into intermediate element 12 through the open end 10 so that the third material is located (enclosed) between portions 9 and 12 and the substantially cylindrical article 2 is obtained.

Figure 13:
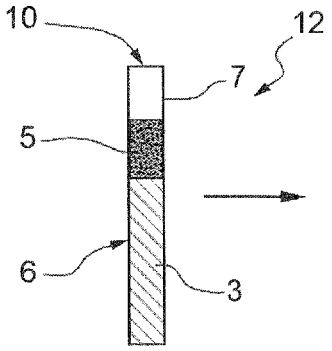
Figure 14:
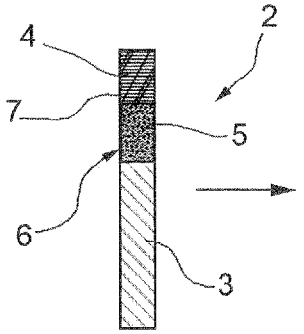

Advantageously, the first and second insertion steps are performed while the open end 10 is facing upwards (FIGS. 12 and 13). In particular, during the first and second insertion steps, intermediate element 9 and intermediate element 12 are oriented vertically.

Advantageously, during the wrapping step, the sheet 7 is arranged substantially horizontally (FIGS. 6 to 8). In addition, or alternatively, the sheet 7 is arranged (more precisely, is fed) substantially horizontally (and longitudinally) prior to the wrapping step.

Advantageously, after the wrapping step, intermediate element 9 is obtained with the open end 10 facing sideways (FIG. 11). In particular, intermediate element 9 is arranged substantially horizontally after the wrapping step.

More specifically, the method also comprises a rotation step, which follows the wrapping step and during which intermediate element 9 is rotated so as to have said open end facing upwards (FIGS. 11 and 12). In particular, during the first and second insertion steps, intermediate element 9 and, respectively, intermediate element 12, are oriented substantially vertically.

According to some embodiments, a plurality of segments 16 comprising the first material (and, in particular of substantially twice the length of the first portions 3) are arranged in succession along the longitudinal extension of a strip 15, which comprises (more precisely, consists of) a plurality of said sheets 7 connected to each other and arranged in succession such that there is a respective gap 18 between two successive segments 16.

In particular, during the wrapping step, the strip 15 is wrapped around segments 16 comprising (in particular, consisting of) the first material such that there is a respective gap 18 between two successive segments 16 and so as to obtain a rod 17 (tubular, with a substantially cylindrical shape and substantially circular cross-section) having a plurality of successive connected intermediate elements 9 (FIGS. 6 to 8).

According to some embodiments, the method comprises a first cutting step, during which the rod 17 is cut (FIG. 8) crosswise (in particular, so as to obtain pairs of connected intermediate elements 9). More precisely, the rod 17 is cut at (in particular, substantially halfway along) segments 16. In particular, the rod 17 is conveyed horizontally (and longitudinally) during the cutting step.

Advantageously, the method comprises a second cutting step, in which the pair 21 of first intermediate elements 9 is cut so as to obtain intermediate elements 9. More precisely, the pair 21 of first intermediate elements 9 is cut at (in particular, substantially halfway along) the gap 18. In particular, during the second cutting step, the pair 21 of first intermediate elements 9 is cut crosswise.

According to alternative embodiments, the method comprises a first cutting step, in which the rod 17 is cut crosswise at (in particular, substantially halfway along) the gaps 18 so as to obtain pairs of connected first intermediate elements 9. In particular, the rod 17 is conveyed longitudinally in the cutting step. In addition, or alternatively, in the second cutting step, the pair of intermediate elements 9 is cut at (in particular, substantially halfway along) the first segments 16 so as to obtain the intermediate elements 9. In particular, the pair of intermediate elements 9 is conveyed transversely during the second cutting step.

According to some embodiments, the intermediate element 9 is conveyed transversely (in particular, substantially horizontally) through an insertion station 36 during the first insertion step.

Advantageously, during the first insertion step, an insertion nozzle 40 is brought inside the intermediate element 9 through the open end 10. In particular, the loose third material passes through the nozzle 40 for insertion into the first intermediate element.

Advantageously, the intermediate element 12 is conveyed transversely (in particular, substantially horizontally) through an insertion station 46 during the second insertion step.

Advantageously, the method comprises a step of applying an adhesive substance, which is before the second insertion step and after the first insertion step and during which an adhesive substance is applied inside the open end 10.

Advantageously, the method comprises a positioning step, which is before the second insertion step and after the first insertion step and in which the open end 10 is brought inside the insertion outlet 50 by means of a relative (in particular, longitudinal and, more precisely, vertical) movement between an insertion outlet 50 and the intermediate element 12. In particular, the second material passes through the insertion outlet 50 for insertion into the intermediate element 12.

Advantageously, in the second insertion step, a force (in particular, radial and centrifugal) is exerted on the sheet 7 at the open end 10 in order to keep it open.

In particular, the force is exerted via aspirators. More precisely, the aspirators comprise suction openings 55 made in the insertion outlet 50 so that they are positioned around the open end 10 at the end of the positioning step.

Advantageously, the second material is at least partly elastically deformable. During the second insertion step, the second material is elastically deformed so as to reduce its lateral size and is subsequently inserted in the intermediate element 12 so as to expand inside the intermediate element 12 (and in particular, close the open end 10).

Advantageously, during the second insertion step, the second material (in particular, portion 4) is pushed (in particular, by means of the pusher head 53) inside the intermediate element 12. More precisely, the second material (in particular, portion 4) is pushed so as to compress portion 3.

Unless specifically indicated otherwise, the content of references (articles, texts, patent applications, etc.) cited in this text is integrally referred to herein for completeness of the description. In particular, the above-mentioned references are incorporated herein for reference.

The invention claimed is:

1. A method of producing cylindrical articles of a tobacco processing industry, each of which articles comprises a respective first portion having a first material of the tobacco processing industry; at least one respective second portion having a second material of the tobacco processing industry; at least one respective third portion having a loose third material different from the first and second materials; and a respective cover comprising at least one sheet wrapped around the respective first portion, the at least one respective second portion, and the at least one respective third portion;

the method comprising a wrapping step, during which the at least one sheet is wrapped around the respective first portion to form a tubular first intermediate element with an open end; a first insertion step, during which the loose third material is inserted through the open end into the first intermediate element to form a second intermediate element; and a second insertion step, during which the second material is inserted through the open end into the second intermediate element, so that the loose third material is located between the respective first portion and the at least one respective second portion and so as to form the cylindrical article; the first and second insertion steps being performed with said open end facing upwards;

wherein during the wrapping step, a strip is wrapped around a plurality of segments comprising the first material in a way such that a respective gap is left between each two successive segments so as to form a rod comprising a plurality of successive connected first intermediate elements; and wherein the method further comprises a first cutting step, during which the rod is cut crosswise at said segments.

2. The method according to claim 1, wherein the segments are twice as long as the respective first portion; and wherein, during the first cutting step, the rod is cut crosswise at said segments to form pairs of connected first intermediate elements.

3. The method according to claim 1, wherein the strip comprises a plurality of said at least one sheet connected together and arranged in succession; and wherein the segments are arranged in succession along a longitudinal extension of the strip so that a respective gap is left between each two successive segments.

4. The method according to claim 1, wherein said at least one sheet is positioned horizontally during the wrapping step.

5. The method according to claim 4, wherein, following the wrapping step, the first intermediate element is obtained with said open end facing sideways; the method also comprising a rotation step, following the wrapping step, in which the first intermediate element is rotated so that said open end is positioned facing upwards.

6. The method according to 2, further comprising a second cutting step, in which at least one of the pairs of first intermediate elements is cut at said respective gap to form the first intermediate elements.

7. The method according to claim 1, wherein, during the first insertion step, the first intermediate element is conveyed transversely, through a first insertion station.

8. The method according to claim 1, wherein, in the first insertion step, a relative movement is produced between an insertion nozzle and the first intermediate element, so as to insert the insertion nozzle through said open end into the first intermediate element; and wherein said loose third material is inserted into the first intermediate element through said insertion nozzle.

9. The method according to claim 1, wherein, in the second insertion step, the second intermediate element is conveyed transversely through a second insertion station.

10. The method according to claim 1, further comprising an adhesive substance application step before the second insertion step and after the first insertion step, in which an adhesive substance is applied to an inside of said open end.

11. The method according to claim 1, further comprising a positioning step before the second insertion step and after the first insertion step, in which, by means of a relative movement between an insertion outlet and the second intermediate element, said open end is inserted inside the insertion outlet; wherein said second material is inserted into the second intermediate element through said insertion outlet.

12. The method according to claim 1, wherein, during the second insertion step, a force is exerted on said at least one sheet at said open end to keep the open end open.

13. The method according to claim 12, wherein the force is exerted by means of aspirators.

14. The method according to claim 1, wherein the second material is at least partly elastically deformable; and wherein the second material is elastically deformed in the second insertion step, so as to reduce its lateral size, and then is inserted in the second intermediate element, so as to expand inside the second intermediate element.

15. The method according to claim 1, wherein said second material is pushed into the second intermediate element in the second insertion step.

16. The method according to claim 1, wherein the rod is conveyed longitudinally during the first cutting step.

17. The method according to claim 1, wherein the first intermediate element is arranged horizontally, following the wrapping step.

18. The method according to claim 1, wherein the first intermediate element and the second intermediate element are oriented vertically during the first and second insertion steps, respectively.

19. The method according to claim 11, wherein, during the second insertion step, a force is exerted on said at least one sheet at said open end to keep the open end open; and wherein the force is exerted by means of suction openings formed at the insertion outlet and surrounding the open end at an end of the positioning step.

* * * * *